United States Patent [19]

Hull

[11] 3,934,799

[45] Jan. 27, 1976

[54] HIGH-CAPACITY STEAM HEATING SYSTEM

[76] Inventor: Francis R. Hull, 567 East 26th St., Brooklyn, N.Y. 11210

[22] Filed: May 13, 1974

[21] Appl. No.: 469,475

Related U.S. Application Data

[60] Division of Ser. Nos. 889,262, Dec. 3, 1969, abandoned, and Ser. No. 752,120, July 22, 1968, abandoned, and Ser. No. 690,040, Nov. 14, 1967, abandoned, and Ser. No. 621,381, Jan. 23, 1967, abandoned, and Ser. No. 403,244, Oct. 12, 1964, abandoned, and a continuation-in-part of Ser. No. 284,166, Aug. 28, 1972, abandoned, and a continuation-in-part of Ser. No. 121,795, March 8, 1971, Pat. No. 3,687,867.

[52] U.S. Cl. ..... 237/67; 122/442

[51] Int. Cl.[2] ..... F24D 1/08

[58] Field of Search ..... 237/9 R, 67, 74; 122/442, 122/31 R; 60/107

[56] References Cited

UNITED STATES PATENTS

| | | | |
|---|---|---|---|
| 1,014,919 | 1/1912 | Sweeny et al. | 122/442 |
| 1,377,080 | 5/1921 | Lang | 122/442 |
| 2,515,647 | 7/1950 | Hunt et al. | 237/9 |

*Primary Examiner*—William E. Wayner

[57] ABSTRACT

The contact heating of boiler feed water for steam heating systems is effected by mixing recirculated boiler steam and feedwater within water-jet ejector-type contact heat exchangers. Feedwater heating up to the evaporation (or saturation) temperature for the pressure of the boiler may be achieved within an ejector-type contact heat exchanger in a heating process which is separate from the evaporation process. Gas-to-liquid energy transfer across boiler heating surfaces may be greatly accelerated when feed water is supplied to the boiler at saturation, since liquid boiling heat transfer is known to be much more rapid than that of liquids heating or cooling. The principal effect of the invention is to make a substantial theoretical increase in the effective steaming capacity of the boiler.

11 Claims, 5 Drawing Figures

B
P
V
T

HIGH-CAPACITY STEAM HEATING SYSTEM

The present invention is a continuation-in-part of my presently pending application Ser. No. 284,166 now abandoned, entitled "High-Capacity Steam Heating System" filed Aug. 28, 1972 and a continuation-in-part of 121,795 filed Mar. 8, 1971, now U.S. Pat. 3,687,867; a division of 889,262, filed Dec. 3, 1969, now abandoned; a division of 752,120, filed July 22, 1968, now abandoned; a division of 690,040, filed Nov. 14, 1967, now abandoned; a division of 621,381, filed Jan. 23, 1967, now abandoned and a division of 403,244 filed Oct. 12, 1964, now abandoned.

As used hereinafter, the term "fluid" shall refer to any liquid or gaseous medium;

the term "contact feed heating" shall refer to heating processes wherein boiler feed water is preheated through contact heat exchange with low-pressure steam within velocity-accelerated contact heat exchangers before the liquid feed water is evaporated in the companion steam generator;

the term "contact interchange" shall refer to the fluid-to-fluid exchange of thermal and kinetic energy between adjacent fluid streams having different velocities in parallel flow, and having no physical or mechanical separation between them;

the term "mixing length" shall relate to the effective linear dimension perpendicular to the direction of mean fluid flow within which contact interchange shall take place between a heating fluid stream and a cooling fluid stream; and the term "characteristic length" shall relate to the effective linear dimension parallel to the direction of mean fluid flow within which contact interchange shall take place between a heating fluid stream and a cooling fluid stream.

While the apparatus of the invention is described in connection with contact pre-heating of feed water before it is supplied to evaporative heating processes of a companion boiler or steam generator, it will be understood by those skilled in the art that variations in the steam heating processes described hereinafter using related velocity accelerated contact heat exchange methods may be employed advantageously in other configurations and arrangements without departing from the scope of the invention.

The primary object of the invention is to provide a simplified steam heating plant process which uses velocity-accelerated contact interchange methods for the pre-heating of boiler feed water.

Another important object is to provide practicable contact feed heating means for pre-heating feed water to at or near the limiting saturation enthalpy for the pressure of the steam generator or boiler.

A further object is to provide means for separating the sensible feed water heating process from the latent feed water evaporation process, so that the steam generator or boiler may serve an evaporative function.

Still another object is to provide means to accelerate energy transfer across the heating surface of the steam generator or boiler by supplying its feed water at or near the saturation enthalpy, thereby making substantially increased nucleate boiling energy transfer relationships attainable.

With the foregoing objects in view, together with others which will appear as the description proceeds, the invention resides in the novel assemblage and arrangement of system components in steam heating plant processes which will be described more fully in the discussion, illustrated in the drawings, and particularly pointed out in the claims.

IN THE DRAWINGS:

FIG. 1 is a schematic process diagram of a simplified closed-cycle steam heating plant wherein a plurality of velocity-accelerated contact heat exchangers are supplied with motive feed water and recirculated boiler steam at common supply pressures, while the plurality of contact heat exchangers discharge pre-heated boiler feed water to the common boiler supply pressure. The simplified steam heating plant schematic process diagram of FIG. 1 includes a steam generator or boiler, a plurality of steam radiators in parallel, condensate receiver, condensate pump and velocity-accelerated contact-type feed water heaters, as will be described more fully hereinafter.

FIG. 2 is a fragmentary longitudinal sectional view through one of the contact-type feed heaters, the same being in the form of conventional ejector-type apparatus wherein heating steam is entrained by high-velocity feed water and the mixture is discharged at a common pressure.

FIG. 3 is a simplified schematic process diagram of a closed-cycle steam heating plant which includes a forced circulation steam generator or heating boiler, a plurality of steam radiators, condensate receiver and cycle feed pump. The forced circulation steam generator or heating boiler of FIG. 3 is provided with an auxiliary boiler feed water circulating system which includes a circulating pump, contact heat exchanger and recirculating steam branch connection, and discharges saturated boiler feed water into the boiler member.

Application of velocity-accelerated contact interchange to the pre-heating of boiler feed water by recirculated boiler steam in steam heating plant processes consists of the following states:

1. Conversion of liquid feed water pressure energy to maximum kinetic energy within nozzle passages of the heat exchanger.
2. Introduction of regulated amounts of recirculated boiler steam into the receiving section of the contact heat exchanger.
3. Bring the high-velocity liquid feed water stream and the heating steam fluid stream into physical contact at substantially equal pressure within the mixing section of the heat exchanger while in parallel flow (traveling in the same direction) with respect to each other. The object at this stage is to divide flow within the mixing section of the heat exchanger into fluid laminae having greatly different momenta.
4. The large difference in velocity between the two fluid streams accelerates energy transfer between them. Momentum is substantially transferred over an effective mixing length, and accelerates the transfer of thermal energy from the heating steam over a characteristic length within the mixing section of the heat exchanger.
5. The mixture of condensed and entrained heating steam together with the high-velocity liquid feed water stream is next guided to a minimum velocity, maximum pressure state by flowing through a diffuser passage of the heat exchanger.

6. The combined fluid streams are next discharged from the heat exchanger and flow into the companion steam generator or boiler for evaporation.

Figures 1, 2, 4:
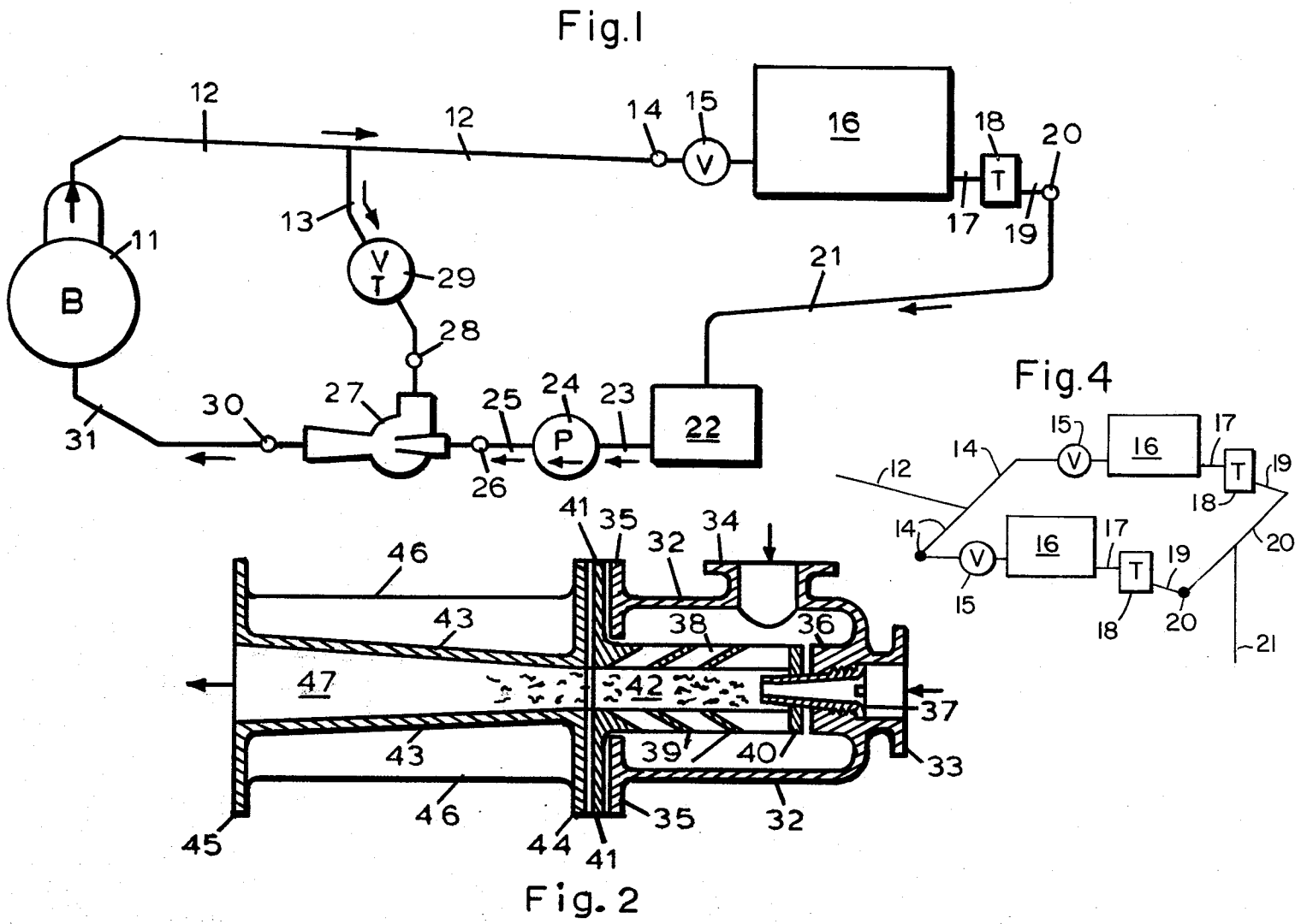
FIG. 4 is a fragmentary isometric sketch conforming to the disclosure of FIG. 1.
Figure 5:
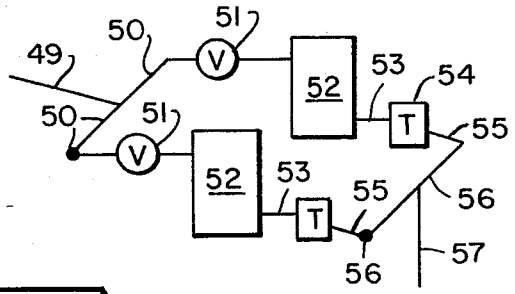
FIG. 5 is a fragmentary isometric sketch which conforms to the disclosure of FIG. 3.

As stated hereinbefore, the illustrative embodiment of FIG. 1 is a simplified schematic process diagram of a closed-cycle steam heating plant which includes improved velocity-accelerated contact heating means.

According to FIG. 1, pressurized steam discharged from steam generator or boiler member 11 flows into main steam header 12, which communicates with both feed heating steam supply branch 13 and heating steam distribution header 14. A minor fraction of steam generated by boiler member 11 is used for heating condensed feed water, and hence recirculated back to steam generator 11 via feed heating steam supply branch 13, contact heat exchangers 27 and boiler feed supply main 31.

Heating steam from main steam header 12 flows into distribution header 14, and thence into plurality of radiator systems 15–19 inclusive. Each radiator system 15–19 inclusive includes a steam inlet branch connection with distribution header 14, inlet valve 15, radiator 16, outlet branch 17, steam trap 18 and condensate discharge branch 19 communicating with condensate collection header 20. Heating steam condensed within each radiator 16 is discharged from its respective steam trap 18 as condensate into collection header 20.

Steam condensate from radiator systems 15–19 flows from collection header 20 into condensate return main 21, and thence into condensate receiver 22. Condensate flows from receiver 22 into pump suction branch 23, and is discharged by feed pump 24 through discharge branch 25 into parallel feed distribution header 26. Parallel feed distribution header 26 distributes and supplies high-pressure feed water to individual nozzle passages of the plurality of water-jet actuated ejector-type contact feed heaters 27. Ejector-type contact feed heaters 27 take suction from steam distribution header 28, which is supplied with minor quantities of recirculated boiler steam from supply line 13 through steam throttle valve 29. The quantity of heating steam flowing into the plurality of ejector-type contact feed heaters 27 is regulated by adjustment of steam throttle valve 29.

The mixture of condensed and entrained steam, together with the pre-heated boiler feed water discharged from each ejector-type contact feed heater 27 is combined in boiler feed collection header 30. The pre-heated boiler feed water flows from feed collection header 30 into feed supply main 31, and thence into steam generator or boiler member 11.

It should be understood that the schematic process diagram of FIG. 1 has been considerably simplified for brevity. An actual installation would include additional auxiliary equipment common to the heating systems and control arts which has been omitted. The auxiliary equipment would include such common equipment as a relief bypass branch communicating between feed pump discharge branch 25 and condensate receiver 22, an air vent for condensate receiver 22, temperature sensing and regulating means disposed in feed discharge piping 30–31 for automatic control of steam throttle valve 29, etc.

As earlier indicated, FIG. 2 is a fragmentary longitudinal sectional view through one of the ejector-type contact feed heaters 27, as shown in FIG. 1. An individual ejector-type contact feed heater is composed of receiving section 32–36 inclusive, motive feed nozzle 37, secondary nozzle assembly 38–41 inclusive, and diffuser section 43–47 inclusive.

High-pressure boiler feed water from feed pump 24 enters receiving section 32–36 inclusive through inlet flange 33, while recirculated heating steam enters through steam inlet flange 34. Receiving section 32–36 inclusive comprises discharge flange 35 and threaded interior boss 36, which houses threaded motive feed nozzle member 37 therein.

Secondary nozzle assembly 38–41 inclusive provides spaced annular secondary-nozzle members 39 to guide the entrainment of heating steam into intimate contact with high-velocity motive feed water within mixing zone 42 of the heat exchanger. Annular secondary-nozzle members 39 are connected rigidly in proper spatial relation by suitable rib members 38, which also rigidly connect the assembly to centering disc 40 and large discharge flange member 41. The central aperture of centering disc 40 seats onto the exterior of motive feed nozzle member 37 when nozzle 37 is threaded into interior boss 36 of receiver section 32–36 inclusive.

Diffuser section 43–47 inclusive provides diffuser shell 43, inlet flange 44, discharge flange 45, exterior ribs 46 and interior diffuser passage 47. The mixture of heating steam and high-velocity feed liquid flows from mixing zone 42 through diffuser passage 47, where condensation of the heating steam is substantially completed as pressure increases.

Discharge flange 35 of receiver section 32–26 inclusive, discharge flange 41 of secondary-nozzle assembly 38–41 inclusive, and inlet flange 44 of diffuser section 43–47 inclusive fit together as shown in FIG. 2. Flange members 35, 41 and 44 are separated by suitable gaskets, and held together by bolted connections or other suitable fasteners common to the steam piping arts.

Figure 3:
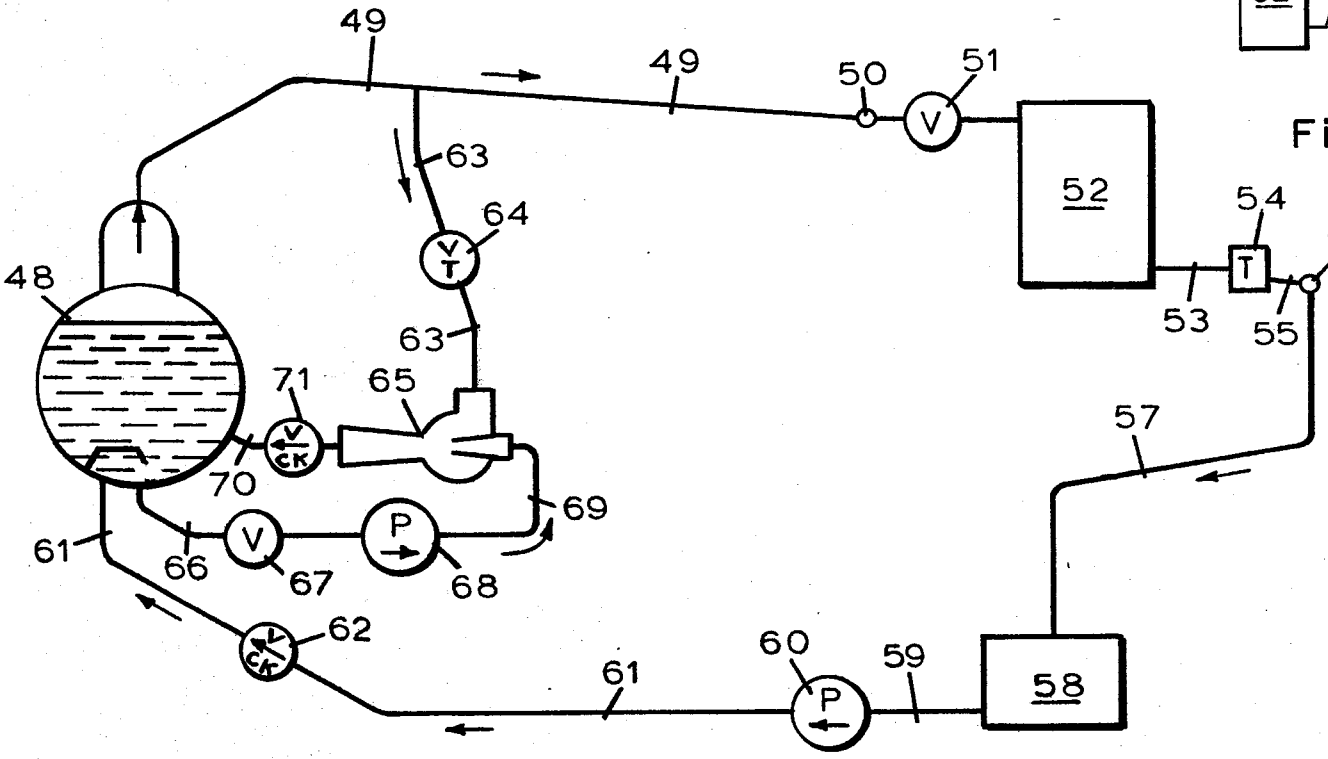

In FIG. 3 pressurized steam flows from forced circulation steam generator or heating boiler member 48 into steam header 49 (communicating the feed heating supply branch 63 and distribution header 50). Heat transfer surfaces of forced circulation steam generator 48 are substantially reserved for evaporative heat transfer, since feed water is substantially heated to saturation by contact mixing within the ejector heat exchanger 65 of the auxiliary circulating and heating system 63–71 inclusive. The closed-cycle heating system of FIG. 3 would otherwise function similarly to the heating system of FIG. 1, as described hereinbefore.

Heating steam from main steam header 49 flows into distribution header 50, and thence into plurality of radiator systems 51–55 inclusive. Each radiator system 51–55 inclusive includes a steam inlet branch connection with distribution header 50, inlet valve 51, radiator 52, outlet branch 53, steam trap 54 and condensate discharge branch 55 communicating with condensate collection header 56. Heating steam condensed within each radiator 52 is discharged from steam trap 54 into condensate collection header 56.

Steam condensate from radiator systems 51–55 flows into condensate return main 57, and thence into receiver 58. Condensate flows from receiver 58 into pump suction branch 59, and is discharged into a baffled zone of forced circulation boiler member 48 by feed pump 60 through feed supply line 61 and check valve 62.

Feed water within forced steam generator or boiler member 48 is maintained at the evaporation or saturation temperature for the boiler pressure by contact mixing within heat exchanger 65 of auxiliary circulating system 63–71 inclusive. Ejector-type contact heat exchanger 65 receives pressurized motive feed water from circulating pump 68 through motive nozzle supply branch 69 and recirculated boiler steam through supply branch 63 and regulating steam throttle valve 64. Circulating feed pump 68 takes suction from a baffled lower zone of steam generator 48 through suction line 66 and valve 67. Ejector-type contact heat exchanger 65 discharges a saturated mixture of condensed recirculating heating steam and heated feed water into forced circulation steam generator or boiler member 48 through discharge branch 70 and check valve 71. The quantity of recirculated heating steam admitted into water-jet ejector-type contact heat exchanger 65 may be automatically regulated by adjustment of steam throttle valve 64, using control apparatus common in the steam heating arts.

From the foregoing, it will be perceived by those skilled in the art that the present process invention provides an effective means for pre-heating boiler feed water in steam heating systems.

While I have shown and described certain specific embodiments of the present invention, it will be readily understood by those skilled in the art that I do not wish to be limited exactly thereto, since various modifications may be made without departing from the scope of the invention as defined in the appended claims.

I claim:

1. A steam heating process in combination: a steam generator or boiler member having integral heating processes; a steam-operated heater adapted to receive heating steam supplied by said steam generator member, to condense said heating steam within its internal passageways as heat energy is transferred through its heating surfaces, and to discharge steam condensate therefrom; means for transferring pressurized heating steam from the outlet of said steam generator to the inlet of said steam-operated heater; a fluid-to-fluid contact heat exchanger adapted to effect the contact pre-heating of high-velocity feed liquid by contact interchange in parallel flow with low-velocity heating steam by means of accelerating nozzle and ejector passageways internally disposed within said contact heat exchanger member; a supply of feed liquid suitable for evaporation within said steam generator member; a liquid feed pump; means for transferring the said supply of feed liquid to the suction of said feed pump; means for transferring pressurized feed liquid from said feed pump to a nozzle passageway of said contact heat exchanger; means for transferring pressurized heating steam from the outlet of said steam generator to the ejector passage of said contact heat exchanger; valve regulating means disposed to control flow of said heating steam into the ejector passageway of said contact heat exchanger to regulate heat absorption by feed liquids passing therethrough; and means for transferring the heated feed liquid discharge of said contact heat exchanger to heating processes of said steam generator; the said contact heat exchanger being adapted to receive and exchange energy between high-velocity feed liquid and heating steam in parallel flow within internal fluid passageways thereof, to combine the thermal energy of the several entering fluid streams, and to discharge pressurized and pre-heated feed liquid from a diffuser passageway thereof; whereby the external effect of the contact feed heating process is to substantially separate the sensible heating of boiler feed liquid from the latent heating for evaporation of said boiler feed liquid within said steam generator, thereby increasing heat transfer capacity and steaming capacity of said steam generator member.

2. The high-capacity steam heating plant of claim 1 wherein a plurality of fluid-to-fluid contact heat exchangers are disposed in parallel with respect to each other between common pressurized feed liquid and heating steam supply headers, and discharges preheated feed liquid from said contact heat exchangers to evaporative heating processes of said steam generator member.

3. The high-capacity steam heating plant of claim 1 wherein the contact heat exchanger is comprised by an ejector having a centrally-disposed nozzle passage surrounded by an outer ejector passage in the receiving section thereof, and discharges the combined fluid streams through a diverging frusto-conical diffuser passage.

4. A high-capacity cyclic steam heating plant comprising in combination: a steam generator having integral heating processes for evaporation of cycle feed liquid; a steam-operated space heater adapted to transfer heat energy through its heating surface while condensing heating steam within internal passageways thereof; an ejector-type fluid-to-fluid contact heat exchanger adapted to effect the pre-heating of high-velocity feed liquid by contact interchange in parallel flow with heating steam supplied from said steam generator; a liquid feed pump; communicating means between the outlet of said steam generator and the inlet of said steam-operated space heater for the transfer of heating steam; communicating means between an outlet of said steam-operated space heater and the suction of said liquid feed pump for the transfer of steam condensate; communicating means from the discharge of said liquid feed pump and accelerating nozzle passageways of said contact heat exchanger for the transfer of pressurized feed liquid; communicating means between an outlet of said steam generator and ejector passageways of said contact heat exchanger for the transfer of heating steam; valve regulating means disposed to control flow of heating steam from said steam generator into ejector passageways of said contact heat exchanger and thereby regulate heat absorption by feed liquids passing therethrough; and communicating means between the fluid discharge of said contact heat exchanger and evaporative heating processes of said steam generator; the said contact heat exchanger being adapted to receive and exchange energy between high-velocity feed liquid and heating steam in parallel flow within internal fluid passageways thereof, to combine the thermal energy of the several entering fluid streams, and to discharge pressurized and pre-heated feed liquid from a diffuser passageway thereof; whereby the external effect of the contact feed heating process is to substantially separate the sensible heating of feed liquid from the latent heating for evaporation of feed liquid within said steam generator, thereby increasing heat transfer capacity and steaming capacity of said steam generator member.

5. The high-capacity cyclic steam heating plant of claim 4 wherein a plurality of fluid-to-fluid contact heat exchangers are disposed in parallel with respect to each other between common pressurized feed liquid and heating steam supply headers, and discharges preheated feed liquid from said contact heat exchangers to evaporative heating processes of said steam generator member.

6. The high-capacity cyclic steam heating plant of claim 4 wherein the contact heat exchanger is comprised by an ejector having a centrally-disposed nozzle passage surrounded by an outer ejector passage in the receiving section thereof, and discharges the combined fluid streams through a diverging frusto-conical diffuser passage.

7. The high-capacity cyclic steam heating plant of claim 4 wherein a plurality of steam-operated space heaters are disposed in parallel with respect to each other and commonly receive heating steam from said steam generator while they commonly discharge steam condensate to the inlet receiver of said liquid feed pump.

8. A high-capacity cyclic steam heating plant comprising in combination: a forced circulation steam generator having integral heating processes for the evaporation of cycle feed water and an auxiliary boiler water circulating system with integral contact heat exchanger; an ejector-type fluid-to-fluid contact heat exchanger member of said boiler water circulating system; a boiler circulating pump; communicating means between the suction of said circulating pump and the liquid storage section of said steam generator member; communicating means between the discharge of said circulating pump and the nozzle passageway of said contact heat exchanger for the supply of pressurized boiler feed water thereinto; communicating means between an outlet of said steam generator and ejector passageways of said contact heat exchanger for the transfer of heating steam thereto; communicating means between the discharge of said ejector-type contact heat exchanger and said steam generator for the transfer of heated feed water thereinto; a steam-operated space heater adapted to transfer heat energy through its heating surface while condensing heating steam within internal passageways thereof; communicating means between the outlet of said steam generator and the inlet of said space heater for the transfer of heating steam; a cycle feed pump; communicating means between an outlet of said steam-operated space heater and the suction of said cycle feed pump for the transfer of steam condensate thereto; and communicating means between the discharge of said cycle feed pump and said steam generator for the transfer of pressurized feed water thereinto.

9. The high-capacity cyclic steam heating plant of claim 8 wherein valve regulating means are disposed in the steam supply branch of said circulating contact heat exchanger to control the flow of circulating steam thereinto.

10. The high-capacity cyclic steam heating plant of claim 8 wherein the circulating contact heat exchanger is comprised by an ejector having a centrally-disposed nozzle passage surrounded by an outer ejector passage in the receiving section thereof, and discharges the combined fluid streams through a diverging frusto-conical diffuser passage.

11. The high-capacity cyclic steam heating plant of claim 8 wherein a plurality of steam-operated space heaters are disposed in parallel with respect to each other and receive heating steam from said steam generator while discharging steam condensate to the receiver of said cycle feed pump.

* * * * *